US006969792B2

(12) United States Patent
Wang

(10) Patent No.: US 6,969,792 B2
(45) Date of Patent: Nov. 29, 2005

(54) SELF-LOCKING KEYBOARD BRACKET

(75) Inventor: Chia-Ming Wang, Taipei (TW)

(73) Assignee: Sallas Industrial Co., Ltd., Taipei (TW)

( * ) Notice: Subject to any disclaimer, the term of this patent is extended or adjusted under 35 U.S.C. 154(b) by 0 days.

(21) Appl. No.: 10/842,506

(22) Filed: May 11, 2004

(65) Prior Publication Data

US 2005/0188812 A1 Sep. 1, 2005

(30) Foreign Application Priority Data

Feb. 18, 2004 (TW) ..... 93103993 A

(51) Int. Cl.[7] ..... G10C 3/02
(52) U.S. Cl. ..... 84/177
(58) Field of Search ..... 84/174, 176, 177; 248/200, 205.1, 309.1, 274.1, 443

(56) References Cited

U.S. PATENT DOCUMENTS 4,641,565 A * 2/1987 Tachida et al. ..... 84/437
5,861,566 A * 1/1999 Kaneko et al. ..... 84/13

* cited by examiner

*Primary Examiner*—Kimberly Lockett
(74) *Attorney, Agent, or Firm*—Rosenberg, Klein & Lee

(57) ABSTRACT

A self-locking keyboard bracket is disclosed to include a four-bar linkage, formed of a base frame, a connecting frame, a coupling frame, and a braking mechanism, a supporting frame fastened pivotally with the coupling frame, and an angle adjustment control unit for locking the supporting frame to the coupling frame at the desired angle by means of the operation of a locking bar with a cam. The braking mechanism uses a beveled block to mach with a beveled guide block to further control friction resistance between the base frame and the connecting frame, thereby achieving self-locking of the keyboard bracket.

10 Claims, 14 Drawing Sheets

SELF-LOCKING KEYBOARD BRACKET

BACKGROUND OF THE INVENTION

1. Field of the Invention

The present invention relates to a keyboard bracket and more particularly, to a self-locking keyboard bracket, allowing the user to conveniently adjust the elevation and angle of the supporting frame.

2. Description of Related Art

Following fast development of information industry, computer is becoming a popular equipment used in office as well as at home for paper working to substitute conventional writing apparatus. In consequence, computer peripheral apparatus such as keyboard and mouse have come intimate partners of a computer user. However, regular computer peripheral apparatus occupy much installation gap space. It is difficult to find a gap space on the limited area of the top of a table for receiving a computer peripheral apparatus. It is also inconvenient to operate a computer peripheral apparatus on the top of a table. When installed a computer peripheral apparatus, the elevation and angle of the computer peripheral apparatus may not fit the user perfectly, and the user may ache all over within a short period of time in operating the computer peripheral apparatus. In order to eliminate this problem, adjustable bracket means may be used to support a computer peripheral apparatus on a table for convenient use.

FIGS. 1A~1C show a conventional keyboard bracket for supporting a keyboard on a table. The structure of keyboard bracket comprises a holder base 10, a connecting frame 20, a limiter 25, an adjustment control set 30, a first torsional spring 24, a keyboard support 26, a second torsional spring 28, and a locking mechanism 36. The holder base 10 is a substantially ⊓-shaped solid frame. The connecting frame 20 is a substantially ⊓-shaped frame bar having a first pivot hole 21 at one end, a second pivot hole 23 at the other end, and a smoothly arched sliding slot 22 adjacent to the first pivot hole 21. The first pivot hole 21 and the smoothly arched sliding slot 22 of the connecting frame 20 are respectively pivoted to the holder base 10 by a first pivot pin 11 and a second pivot pin 12. The limiter 25 is a flat rod member longitudinally suspended inside the connecting frame 20, having a pivot hole 252 disposed at one end and coupled to the second pivot pin 12 and a longitudinal sliding slot 253 disposed at the other end and coupled to the second pivot hole 23 of the connecting frame 20. The adjustment control set 30 comprises a pivot pin 31 pivotally fastened to a pivot hole 261 in one end of the keyboard support 26 and the second pivot hole 23 of the connecting frame 20 and the longitudinal sliding slot 253 of the limiter 25, a traction plate 32 coupled between the pivot pin 31 and the keyboard support 26, a barrel 34 sleeved onto the pivot pin 31 and stopped between the locking mechanism 36 and the traction plate 32, a spring member 33 mounted on the pivot pin 31 and stopped between the traction plate 32 and one end of the barrel 34, a cushion 37 mounted on the pivot pin 31 and supported between the traction plate 32 and the spring member 33, and washers 35 mounted on the pivot pin 31 at the two distal ends of the barrel 34. The first torsional spring 24 is mounted on the first pivot pin 11 and connected between the holder base 10 and the connecting frame 20. The keyboard support 26 is shaped like a channel bar for supporting a keyboard or computer peripheral apparatus. The second torsional spring 28 is mounted on a pin in the keyboard support 26 and connected between the connecting frame 20 and the keyboard support 26. The locking mechanism 36 comprises an eccentric block 36 coupled to the pivot pin 31, the eccentric block 36 being a parallelogram having a long side 362, a short side 364, and an arched opening 363, a locating block 365 extended from one side of the eccentric block 36, and a handle 367 fastened to the locating block 365 for turning the eccentric block 36. By means of operating the handle 367 to turn the eccentric block 36 relative to the keyboard support 26, and the limiter 25 and the traction plate 32 can be loosened, enabling the keyboard support 26 to be adjusted to the desired elevation or angle.

Referring to FIGS. 2A and 2B, when wishing to adjust the elevation or angle of the keyboard support 26, operate the handle 367 to move the eccentric block 361, causing the position of the arched opening 363 of the eccentric block 361 to be changed through 90° angle relative to the pivot pin 31. At this time, the long side 362 of the eccentric block 361 is moved into contact with one washer 35 against the barrel 34, and the short side 364 of the eccentric block 361 is moved to the axial direction of the pivot pin 31, and therefore the eccentric block 361 occupies less axial gap space around the pivot pin 31, allowing the spring member 33 to push the barrel 34 outwards. Upon outward displacement of the barrel 34 along the pivot pin 31, the limiter 25, the cushion 37 and the traction plate 32 are loosened.

Referring to FIGS. 3A and 3B, when wishing to adjust the angle of the keyboard support 26, operate the handle 367 to loosen the keyboard bracket as stated above, and then turn the keyboard support 26 about the pivot pin 31 relative to the connecting frame 20 to the desired angle, and then turn the handle 367 in the reversed direction to force the short side 364 of the eccentric block 361 against the washers 35, the barrel 34 and the spring member 33, and at the same time the long side 362 of the eccentric block 361 is moved to the axial direction of the pivot pin 31 to occupy more axial gap space around the pivot pin 31, and therefore the barrel 34 is forced into the inside of the keyboard support 34 to compress spring member 33 against the cushion 37, the limiter 25 and the traction plate 32, and therefore the keyboard support 26 is locked to the connecting frame 20.

When wishing to adjust the elevation of the keyboard support 26, operate the handle 367 to loosen the keyboard bracket, and then turn the connecting frame 20 with the keyboard support 26 about the first pivot pin 11. Because of the keyboard support 26 is coupled to the longitudinal sliding slot 253 of the limiter 25 by the pivot pin 31, the keyboard support 26 is maintained in horizontal when turning the connecting frame 20 about the first pivot pin 11 relative to the holder base 10. When adjusted to the desired elevation, the handle 367 is turned in the reversed direction to lock the limiter 25 and the traction plate 32 again.

This structure of keyboard bracket is functional, however it still has numerous drawbacks as outlined hereinafter.

1. Simply using one adjustment control set to control the elevation and angle of the keyboard bracket does not allow the user to accurately and rapidly adjust the keyboard bracket to the desired position.

2. Upon each elevation or angle adjustment, the eccentric block is forced to rub against the respective washer, therefore the eccentric block starts to wear quickly with the use of the keyboard bracket. When the eccentric block starts to wear, the load carrying power of the keyboard bracket is relatively reduced.

3. The complicated adjustment control set greatly complicates the manufacturing process and increases the manufacturing cost.

SUMMARY OF THE INVENTION

The present invention has been accomplished under the circumstances in view. It is therefore the main object of the present invention to provide a self-locking keyboard bracket, which eliminates the aforesaid drawbacks. According to one aspect of the present invention, the self-locking keyboard bracket uses a four-bar linkage to support a supporting frame for carrying a keyboard, which four-bar linkage is formed of a base frame, a connecting frame, a coupling frame and a braking mechanism. The braking mechanism uses a beveled block to mach with a beveled guide block to further control friction resistance between the base frame and the connecting frame, thereby achieving self-locking of the keyboard bracket. According to another aspect of the present invention, the self-locking keyboard bracket further comprises an angle adjustment control unit, which is controlled by a locking lever with a cam to lock the supporting frame to the coupling frame or unlock the supporting frame from the coupling frame, for enabling the supporting frame to be adjusted to the desired angle. According to still another aspect of the present invention, packing members and washers are used in the braking mechanism to increase friction resistance between parts upon self-locking of the keyboard bracket, thereby increasing the load carrying power of the keyboard bracket.

DETAILED DESCRIPTION OF THE PREFERRED EMBODIMENT

Figure 1A:
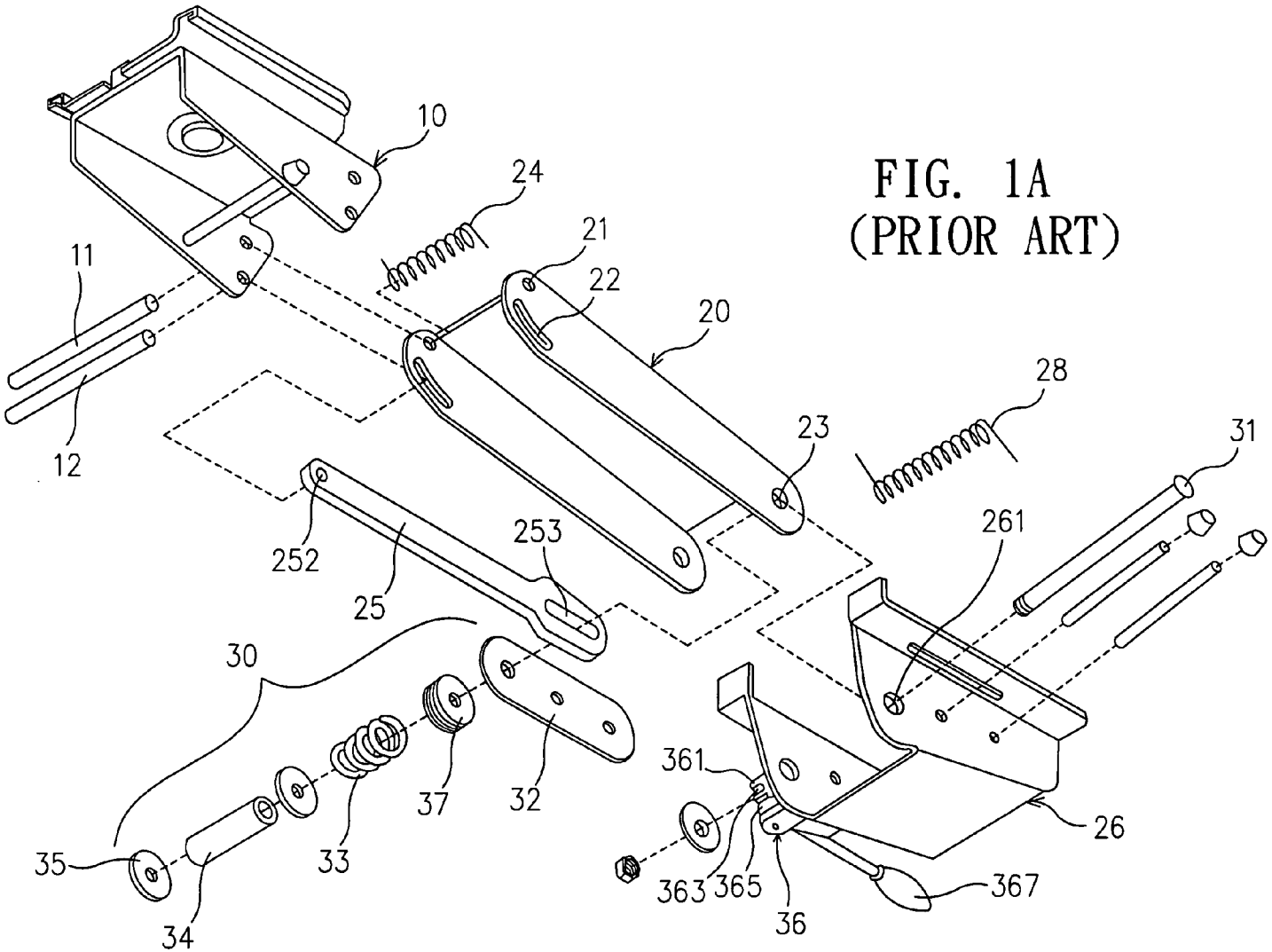
FIG. 1A (PRIOR ART)
FIG. 1A is an exploded view of a keyboard bracket according to the prior art.
Figure 1B:
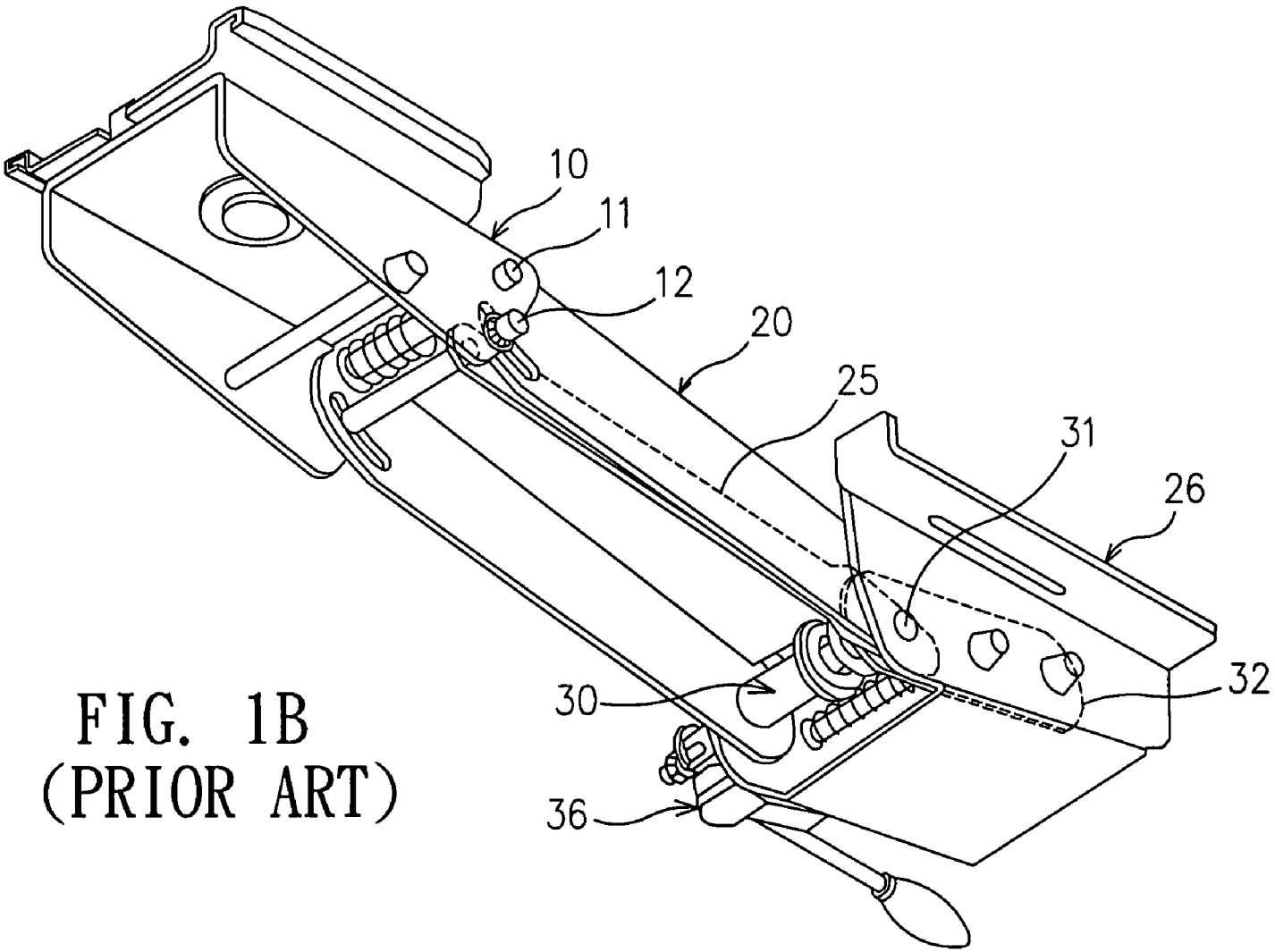
FIG. 1B (PRIOR ART)
FIG. 1B is a perspective assembly view of the keyboard bracket according to the prior art.
Figure 1C:
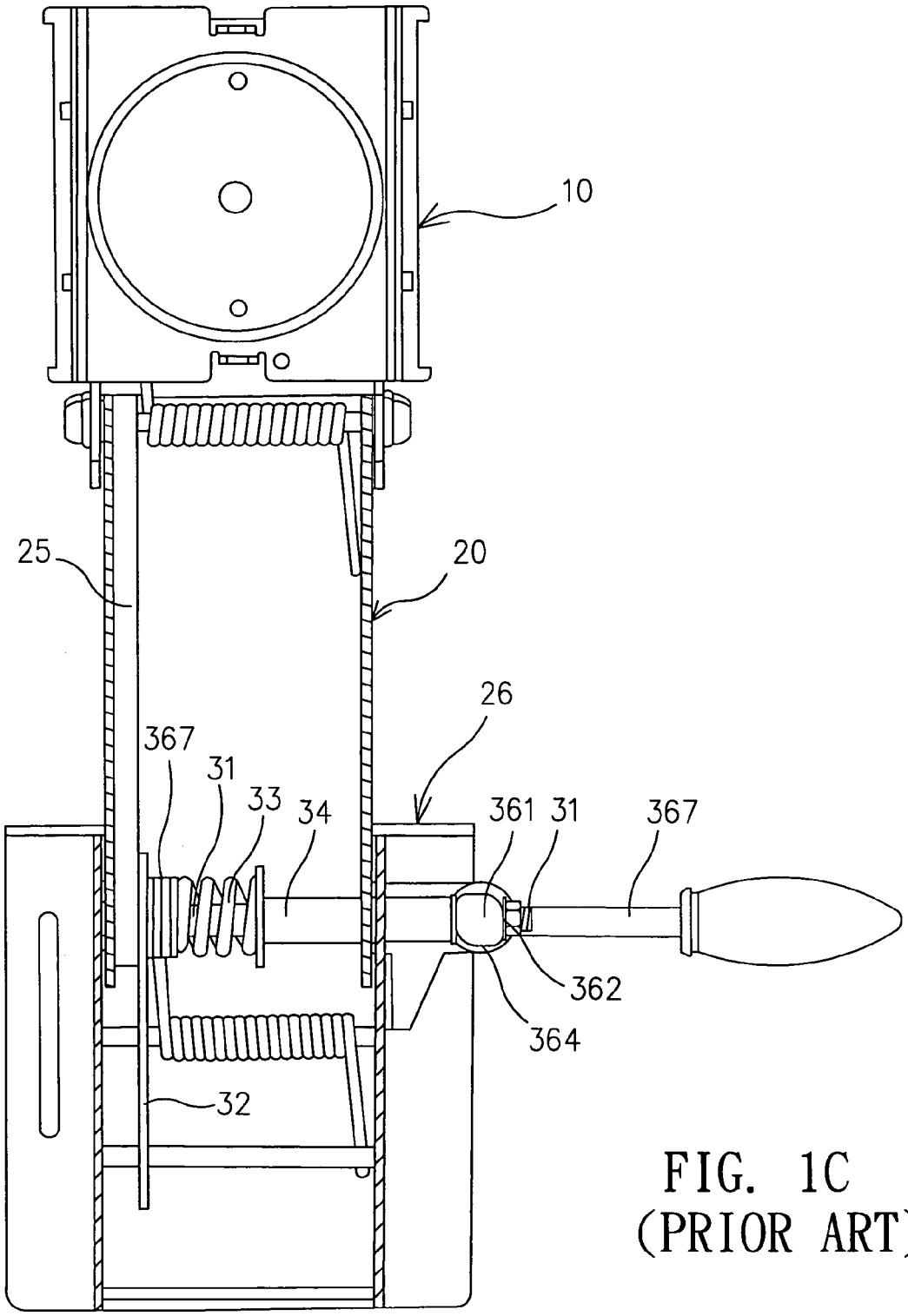
FIG. 1C (PRIOR ART)
FIG. 1C is a top view in section of the keyboard bracket according to the prior art.
Figure 2A:
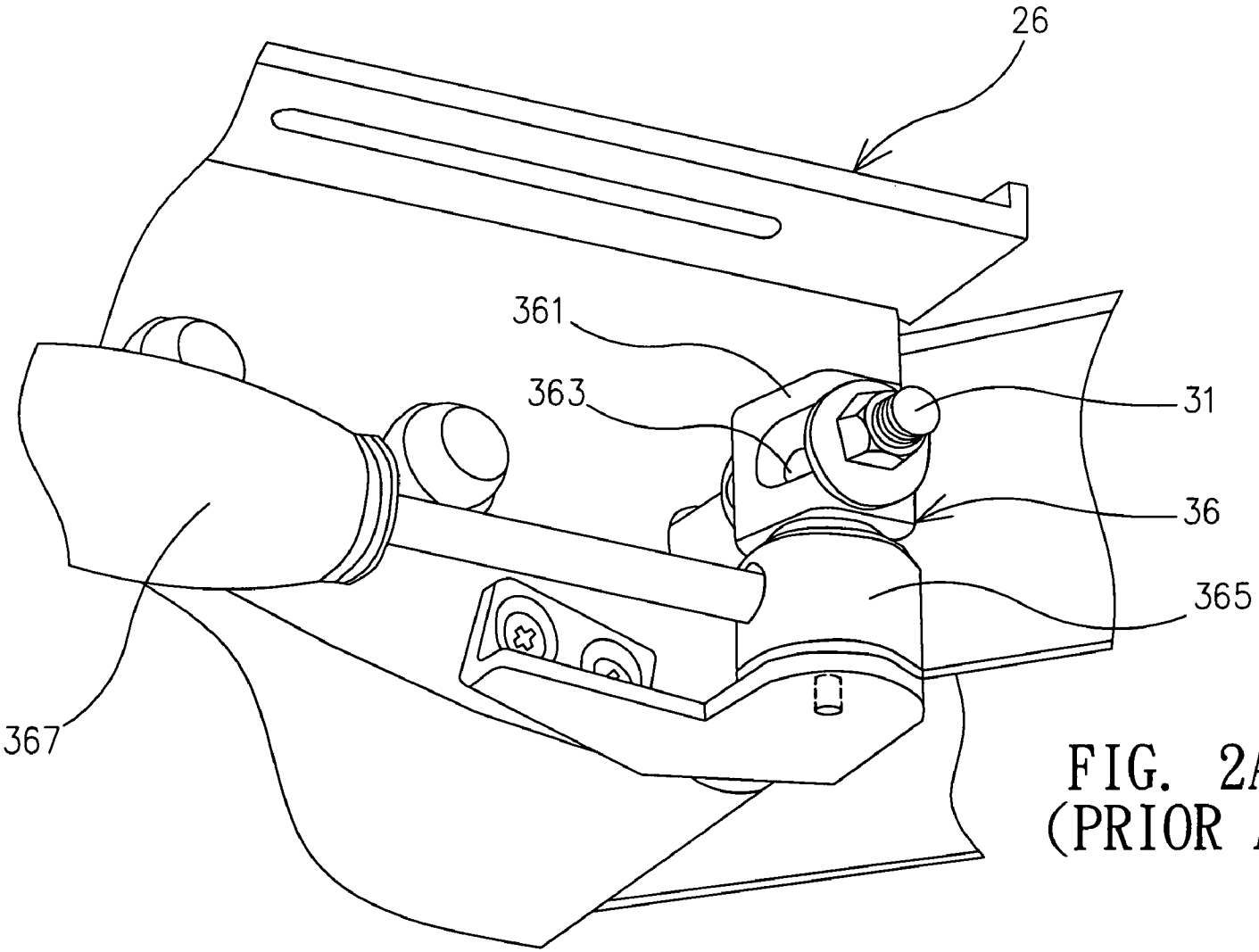
FIG. 2A (PRIOR ART)
FIG. 2A is an enlarged view of a part of the keyboard bracket according to the prior art.
Figure 2B:
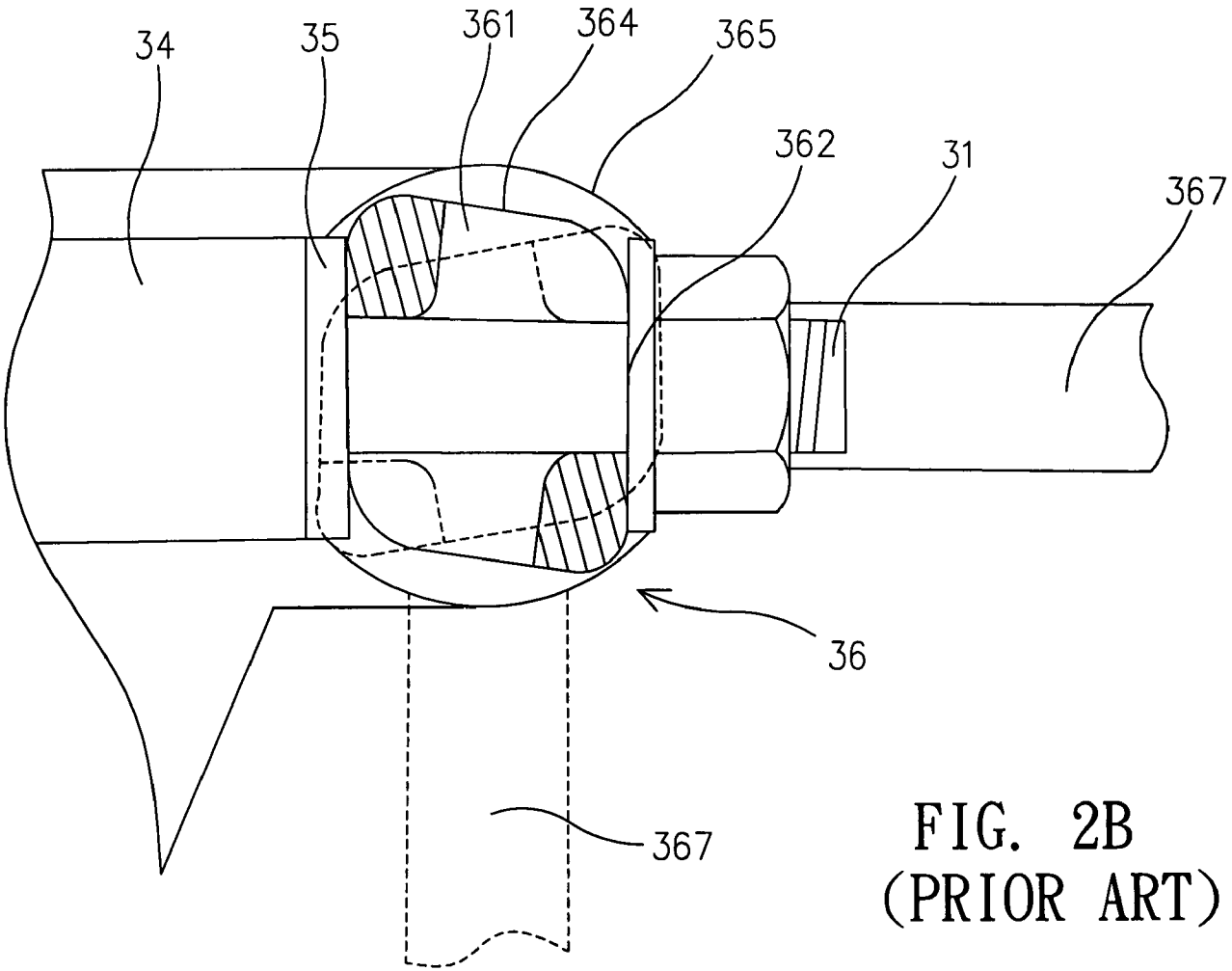
FIG. 2B (PRIOR ART)
FIG. 2B is a top view of FIG. 2A.
Figure 3A:
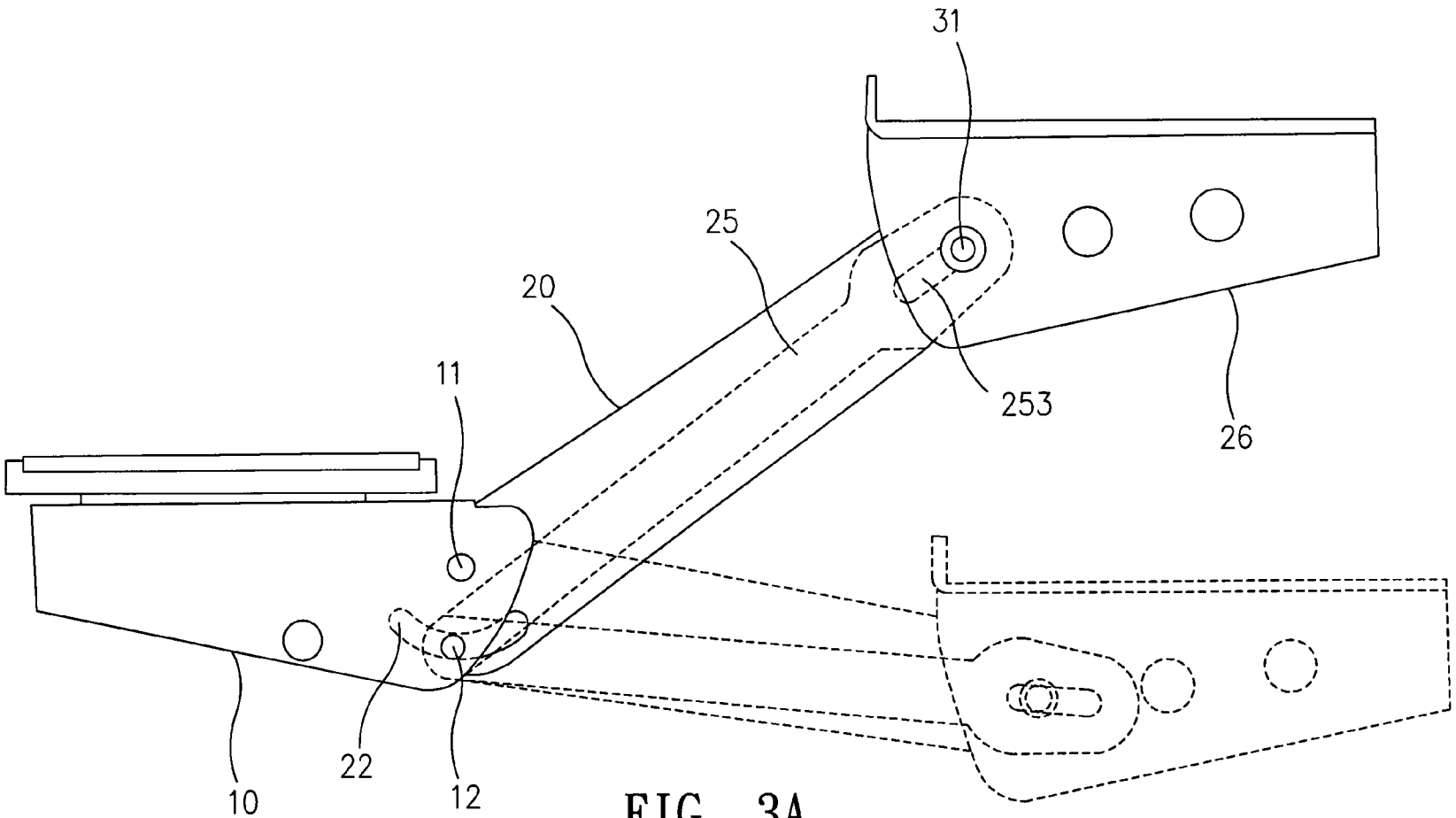
FIG. 3A (PRIOR ART)
FIG. 3A is a schematic side view showing the supporting frame of the keyboard bracket adjusted between a first elevation and a second elevation according to the prior art.
Figure 3B:
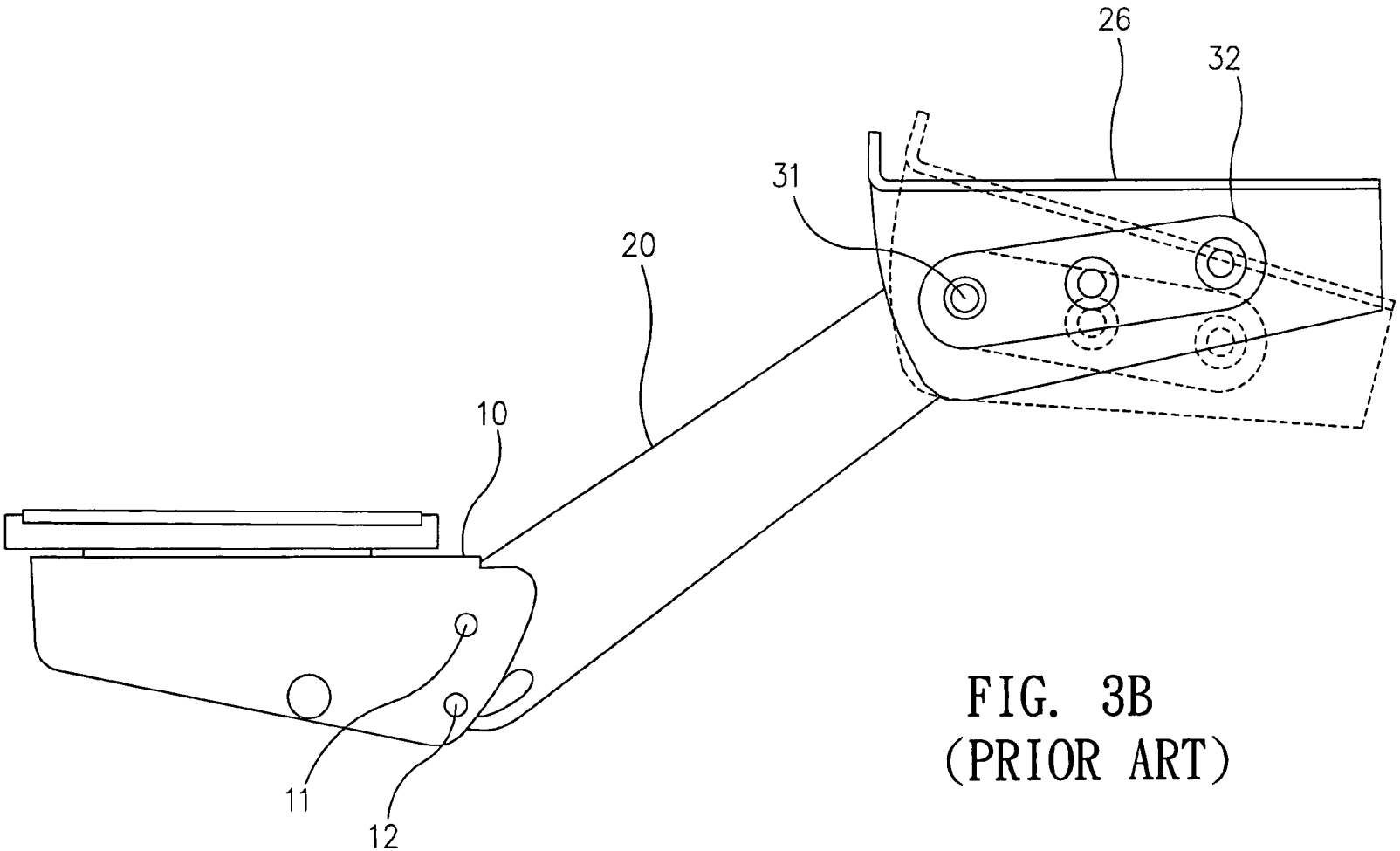
FIG. 3B (PRIOR ART)
FIG. 3B is a schematic side view showing the supporting frame of the keyboard bracket adjusted between a first angle and a second angle according to the prior art.
Figure 4A:
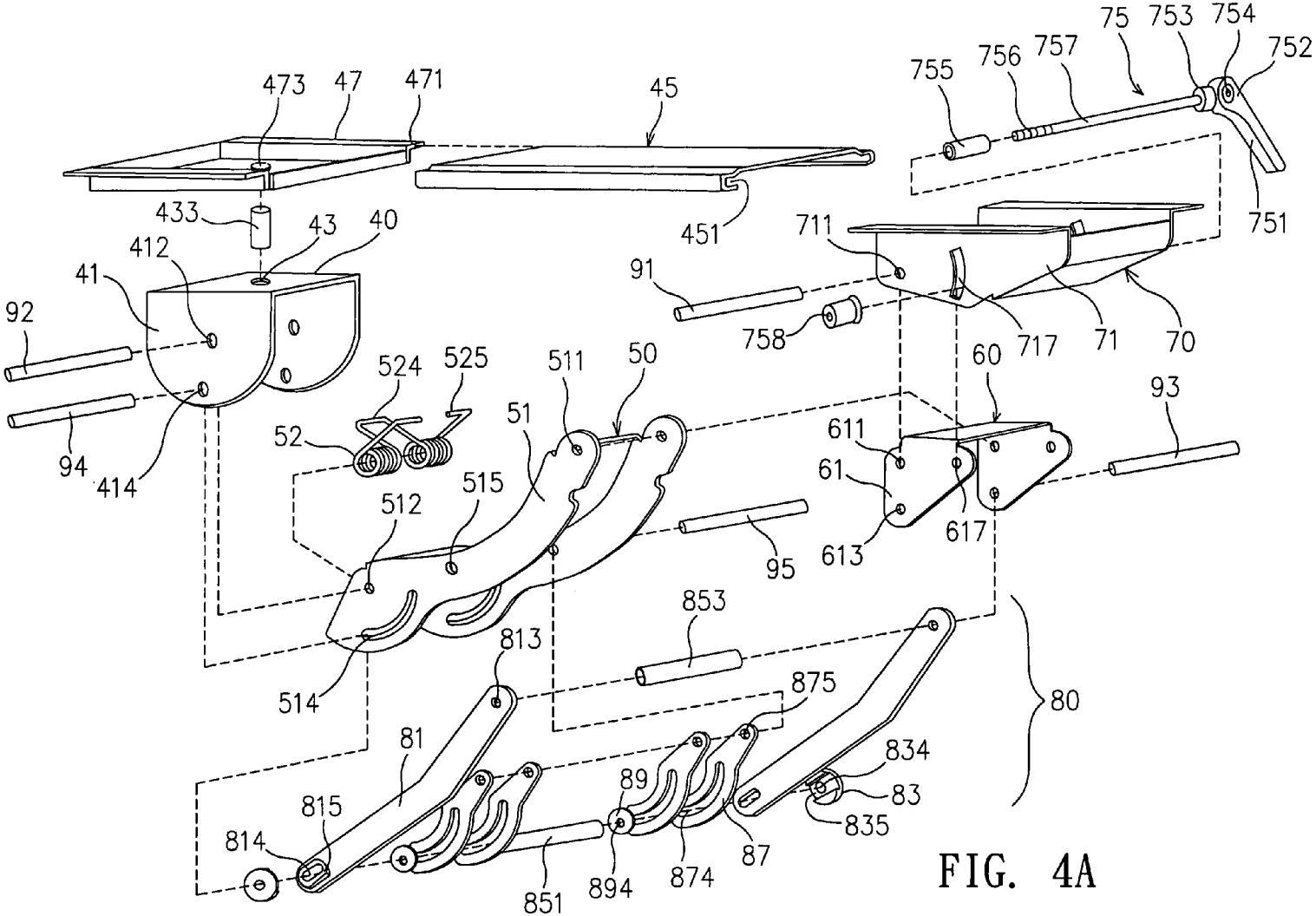
FIG. 4A is an exploded view of a self-locking keyboard bracket according to the present invention.
Figure 4B:
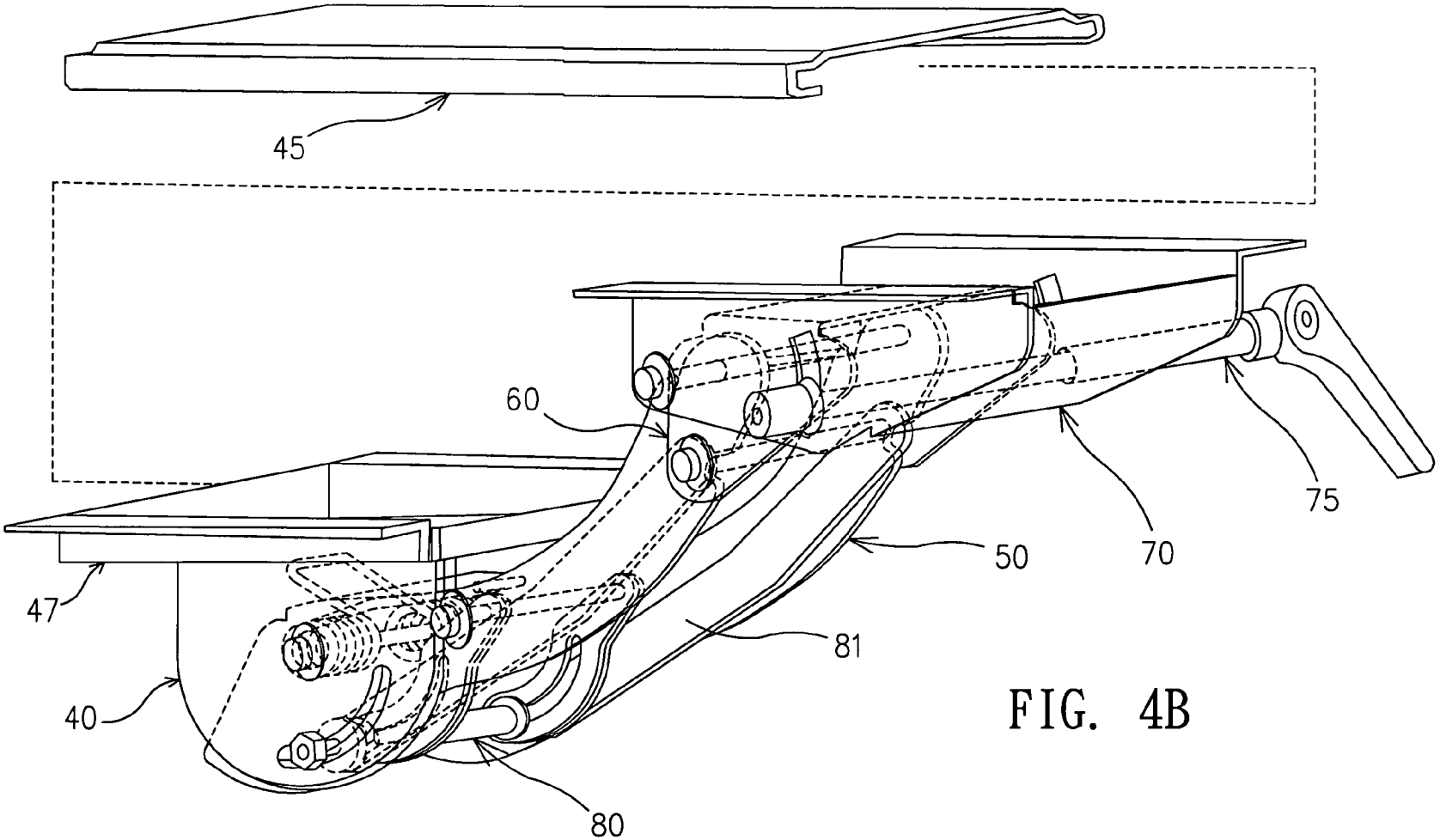
FIG. 4B is a perspective assembly view of the self-locking keyboard bracket according to the present invention.
Figure 5B:
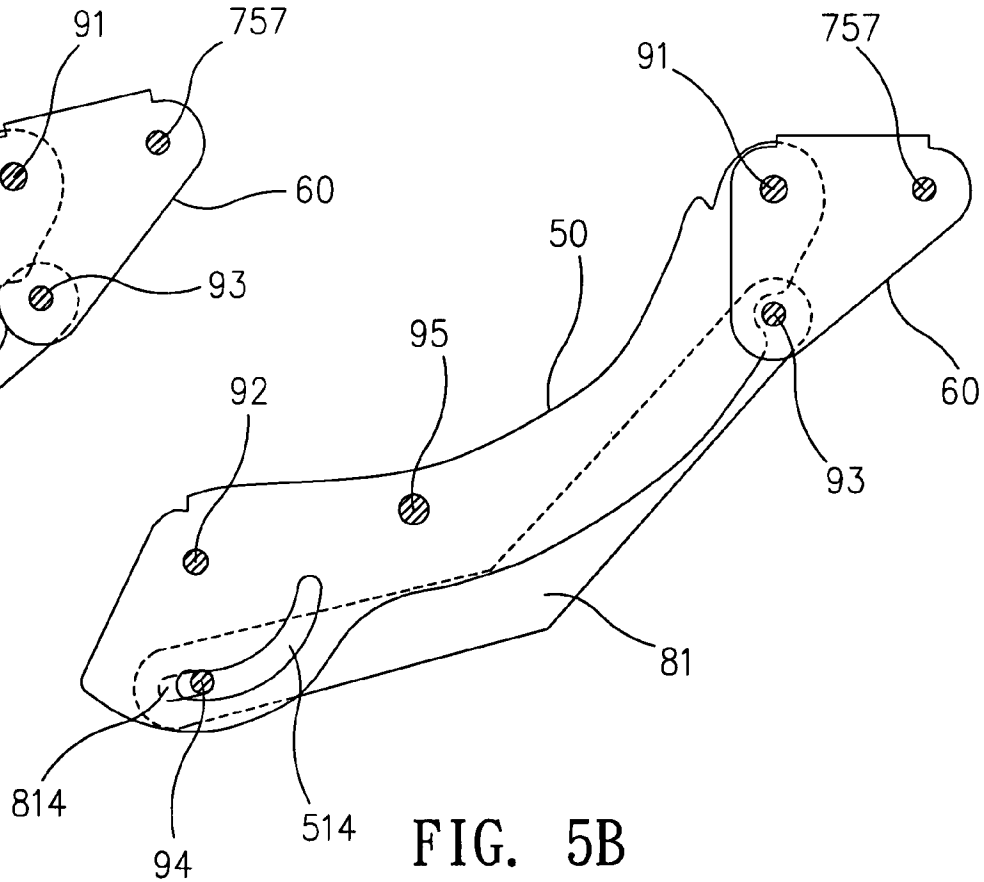
FIG. 5B is similar to FIG. 5A but showing the unlocking status of the braking mechanism.
Figure 5A:
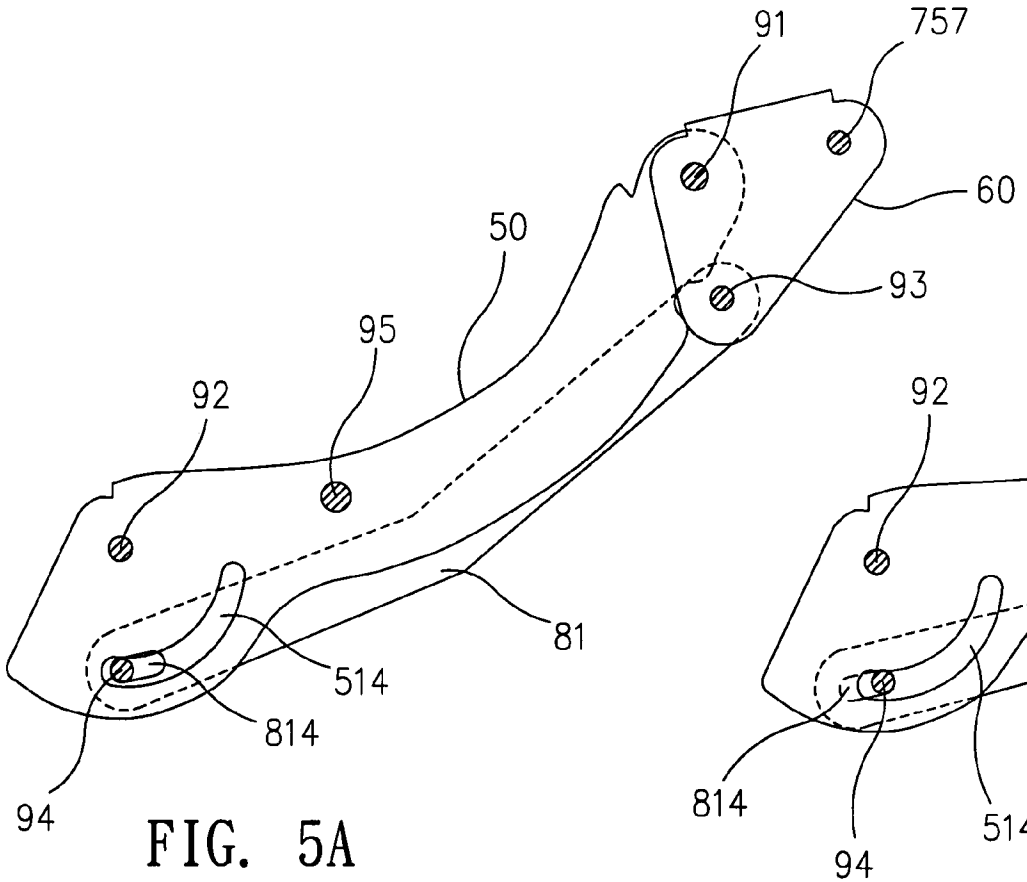
FIG. 5A is a side view in an enlarged scale of a part of the present invention, showing the locking status of the braking mechanism in the connecting frame.
Figure 5D:
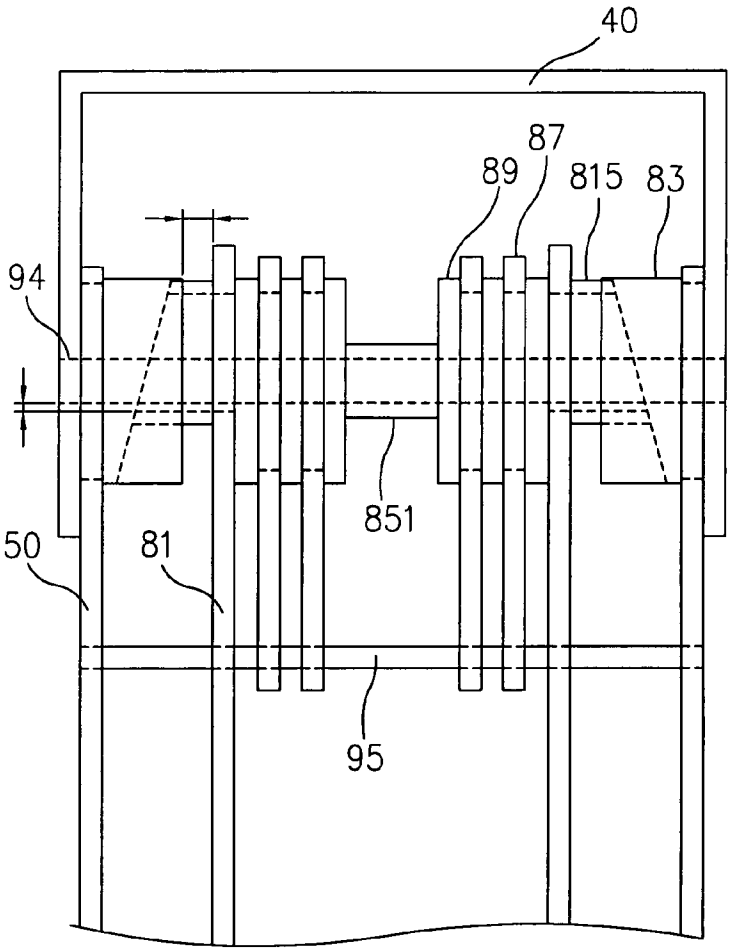
FIG. 5D is similar to FIG. 5C but showing the unlocking status of the keyboard bracket/
Figure 5C:
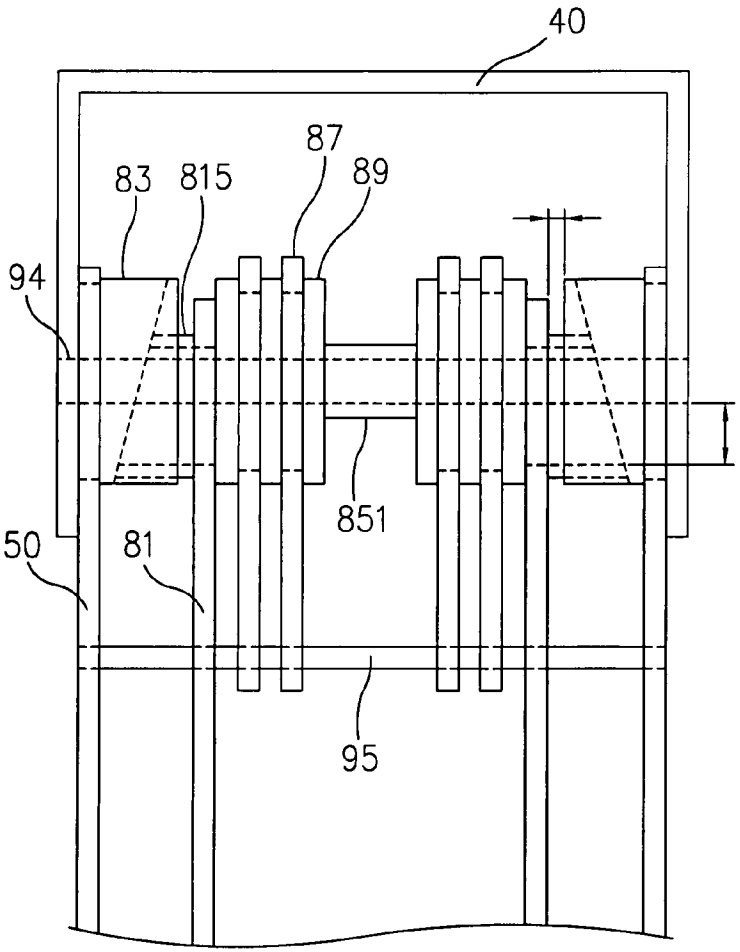
FIG. 5C is bottom view in an enlarged scale of the present invention, showing the locking status of the keyboard bracket.

Referring to FIGS. 4A and 4B, a self-locking keyboard bracket in accordance with the present invention is shown comprised of a base frame 40, a track 45, a slide 47, a connecting frame 50, a coupling frame 60, a supporting frame 70, a braking mechanism 80, and an angle adjustment control unit 75.

The base frame 40 comprises at least one, for example, two downwardly extended side wings 41, a first axle hole 412 horizontally extended through each side wing 41, a second axle hole 414 horizontally extended through each side wing 41 below the first axle hole 412, and a third axle hole 43 vertically extended through the top wall thereof.

The track 45 comprises two parallel sliding grooves 451.

The slide 47 comprises two side flanges 471 longitudinally slidably inserted into the sliding grooves 451 for allowing relative movement between the slide 47 and the track 45, and a vertically extended axle hole 473 connected to the third axle hole 43 of the base frame 40 by a pivot pin 433 for allowing relative rotation in horizontal direction between the slide 47 and the base frame 40.

The connecting frame 50 comprises at least one, for example, two downwardly extended side wings 51, a first axle hole 511 transversely extended through each side wing 51 near one end, a second axle hole 512 transversely extended through each side wing 51 near the other end, a third axle hole 515 transversely extended through each side wing 51 on the middle, and a smoothly arched sliding slot 514 cut through each side wing 51 adjacent to the second axle hole 512.

The coupling frame 60 comprises at least one, for example, two downwardly extended side wings 61, and three axle holes, namely, the first axle hole 611, the second axle hole 617 and the third axle hole 613 transversely extended through each side wing 61.

The supporting frame 70 comprises at least one, for example, two downwardly extended side wings 71, an axle hole 711 and a smoothly arched sliding slot 717 cut through each side wing 71.

The braking mechanism 80 is comprised of at least one, for example, two links 81, two beveled guide blocks 83, a first sleeve 851, a second sleeve 853, packing members 87, and washers 89. The links 81 are arranged in parallel, each having a first end, which has a transversely extended axle hole 813, and a second end, which is fixedly provided with a beveled block 815 and has an axle hole 814 transversely extended through the beveled block 815. The beveled guide blocks 83 each have a coupling groove 835 disposed at one side and coupled to the beveled block 815 of one link 81, and an axle hole 834 transversely extended through the coupling groove 835. The packing members 87 each have a smoothly arched sliding slot 874 at one end and a transversely extended axle hole 875 at the other end. The washers 89 each have a center axle hole 894.

The angle adjustment control unit 75 is comprised of a locking lever 751, a hollow stop block 753, a barrel 755, an axle 757, and a fastening device 758. The locking lever 751 has a cam 752 fixedly disposed one end and pivotally connected to one end of the axle 757 by a pivot 754. The axle 757 has the other end provided with an outer thread 756. The fastening device 758 according to this embodiment is a cap nut threaded onto the outer thread 756 of the axle 757. The axle 757 is inserted through the hollow stop block 753 and the barrel 755 and then the sliding slots 717 in the downward side wings 71 of the supporting frame 70 and the second axle holes 617 in the downward side wings 61 of the coupling frame 60 and then screwed up with the fastening device 758, thereby allowing relative movement between the supporting frame 70 and the coupling frame 60.

Further, a first pivot pin 91 is mounted in the axle holes 711 in the downward side wings 71 of the supporting frame 70, the first axle holes 611 in the downward side wings 61 of the coupling frame 60 and the first axle holes 511 in the downward side wings 51 of the connecting frame 50 to pivotally secure the supporting frame 70, the coupling frame 60 and the connecting frame 50 together. A second pivot pin 92 is mounted in the first axle holes 412 in the downward side wings 41 of the base frame 40, and the second axle holes 512 in the downward side wings 51 of the connecting frame 50. A spring member 52 is sleeved onto the second pivot pin 92, having a protruding middle part 524 retained to the base frame 40 and two distal ends 525 retained to the connecting frame 50. The spring member 52 returns the connecting frame 50 to its former position after the connecting frame 50 being turned relative to the base frame 40. A third pivot 93 is mounted in the third axle holes 613 in the downward side wings 61 of the coupling frame 60 and the axle hole 813 in the first end of each link 81 of the braking mechanism 80 and the second sleeve 853 between the links 81 to pivotally couple the braking mechanism 80 to the coupling frame 60. Due to the effect of the second sleeve 853, relative turning action between the braking mechanism 80 and the coupling frame 60 is smoothened. A fourth pivot pin 94 is mounted in the second axle holes 414 in the downward side wings 41 of the base frame 40, the smoothly arched sliding slots 514 in the downward side wings 51 of the connecting frame 50, the axle holes 834 of the beveled guide blocks 83, the axle hole 814 in the second end of each link 81, the sliding slots 874 of the packing members 87, and the first sleeve 851 to pivotally secure the braking mechanism 80 to the base frame 40, allowing relative swivel motion between the braking mechanism 80 and the base frame 40. Thus, the base frame 40, the connecting frame 50, the braking mechanism 80, the coupling frame 60 and the supporting frame 70 form a four-bar linkage keyboard bracket. Further, a fifth pivot pin 95 is mounted in the third axle holes 515 in the downward side wings 51 of the connecting frame 50 and the axle holes 875 of the packing members 87 to hold the packing members 87 between the connecting frame 50 and the braking mechanism 80.

Referring to FIGS. 5A~5D, when turning the coupling frame 60 about the first pivot pin 91 relative to the connecting frame 50, the third pivot pin 93 is forced to move the links 81, however, because the diameter of the second axle holes 814 of the links 81 (the axle holes in the second ends of the links), the fourth pivot pin 94 which is constrained by the second axle holes 414 of the base frame 40 is forced to move relative to the links 81 at this time. Therefore, the beveled blocks 815 of the links 81 are forced to move along the grooves 835 of the beveled guide blocks 83 to increase or reduce the gap in between the members coupled to the fourth pivot pin 94. However, because the gap between the two downward side wings 41 of the base frame 40 is fixed, reducing/increasing the gap between each two adjacent members that are coupled to the fourth pivot pin 94 produces a resisting force or releases the force, thereby locking/unlocking the keyboard bracket. Further, the fourth pivot pin 94 is inserted through the axle holes 894 of the washers 89 to support the washers 89 between the links 81 and the packing members 87 and between the packing members 87 and the first sleeve 851 to increase friction resisting during locking of the keyboard bracket. Because the packing members 87 are provided between the connecting frame 50 and the braking mechanism 80, turning the connecting frame 50 about the second pivot pin 92 relative to the base frame 40 causes the fifth pivot pin 95 to drag the packing members 87, and therefore the fourth pivot pin 94 is moved along the smoothly arched sliding slots 874 of the packing members 87 relative to the packing members 87. Thus, it is necessary to turn the coupling frame 60 within a limited small angle when locking/unlocking the keyboard bracket. When locked, the keyboard bracket supports a heady keyboard and the pressure from the user's wrist stably, enabling the user to operate the keyboard comfortably.

Figures 6A, 6B:
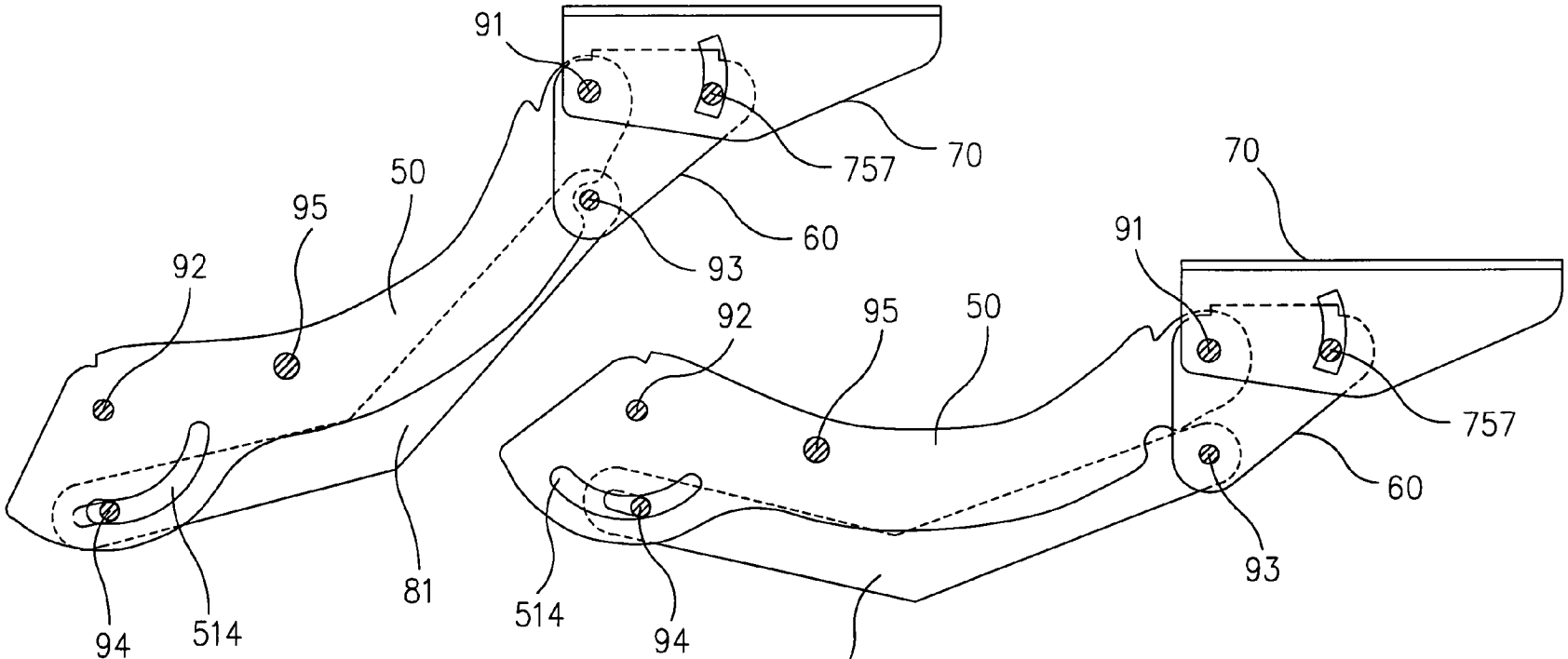
FIG. 6A is a side view in an enlarged scale of a part of the present invention, showing the supporting frame adjusted to a first elevation.
FIG. 6B is similar to FIG. 6A but showing the supporting frame adjusted to a second elevation.

Referring to FIGS. 6A and 6B, when turning the coupling frame 60 to unlock the keyboard bracket, at this time the connecting frame 50 is turned about the second pivot pin 92 relative to the base frame 40, and the fourth pivot pin 94, due to the constraint of the second axle holes 414 of the base frame 40, is forced to move along the smoothly arched sliding slots 514 of the connecting frame 50. During this turning action, the braking mechanism 80, the coupling frame 60 and the supporting frame 70 are moved with the connecting frame 50. After having turned the supporting frame 70 to a proper elevation, stop turning the coupling frame 60, allowing the coupling frame 60 to be forced downwards by the load at the keyboard bracket, and therefore the keyboard bracket is locked at the desired elevation.

Figure 7:
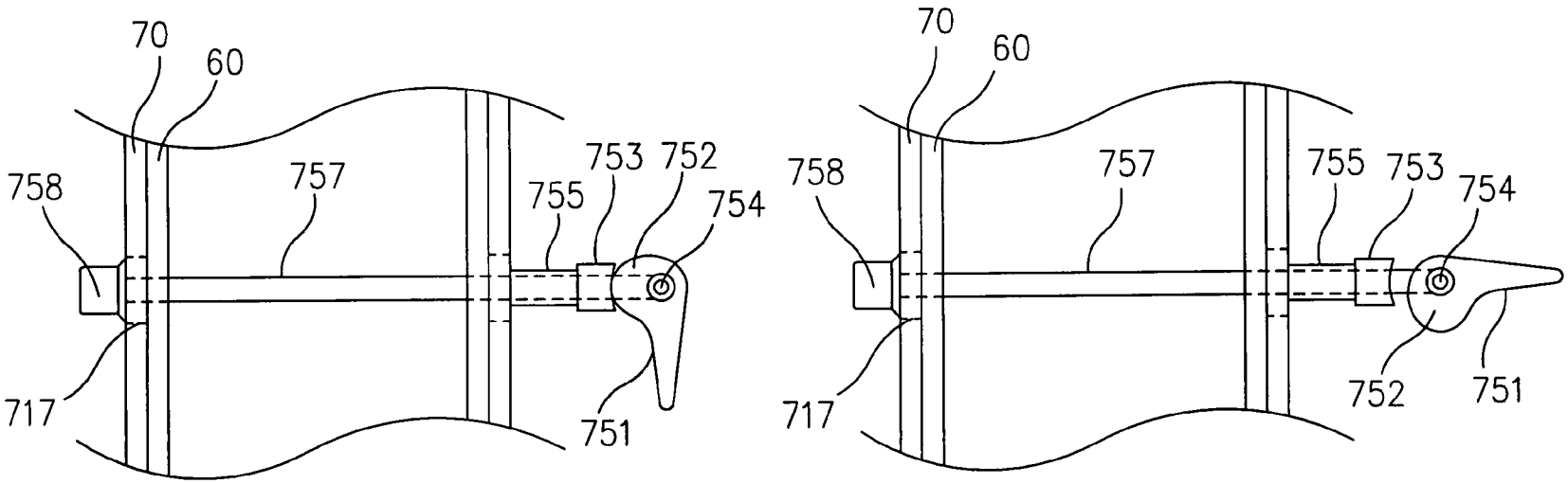
FIG. 7 is top views in an enlarged scale of a part of the present invention, showing the locking status and unlocking status of the angle adjustment control unit.

Referring to FIG. 7, as indicated above, the cam 752 of the locking lever 751 is pivoted to one end of the axle 757 with the pivot 754, therefore the locking lever 751 can be turned relative to the axle 757 between two positions, namely, the locking position and the unlocking position. When turning the locking lever 751 to the locking position, the cam 752 forces the stop block 753 against the barrel 755 to move the supporting frame 70 and the coupling frame 60 leftwards, and at the same time the locking lever 751 pulls the axle 757 rightwards. However, because the axle 757 is inserted through the hollow stop block 753 and the barrel 755 and then the sliding slots 717 in the downward side wings 71 of the supporting frame 70 and the second axle holes 617 in the downward side wings 61 of the coupling frame 60 and then screwed up with the fastening device 758, the aforesaid rightward traction force causes the fastening device 758 to act against the supporting frame 70 and the coupling frame 60 in contra to the leftward pressure from the barrel 755, thereby holding down the supporting frame 70 and the coupling frame 60. On the contrary, when turning the locking lever 751 in the reversed direction from the locking position to the unlocking position, the supporting frame 70 and the coupling frame 60 are loosened.

Figures 8A, 8B:
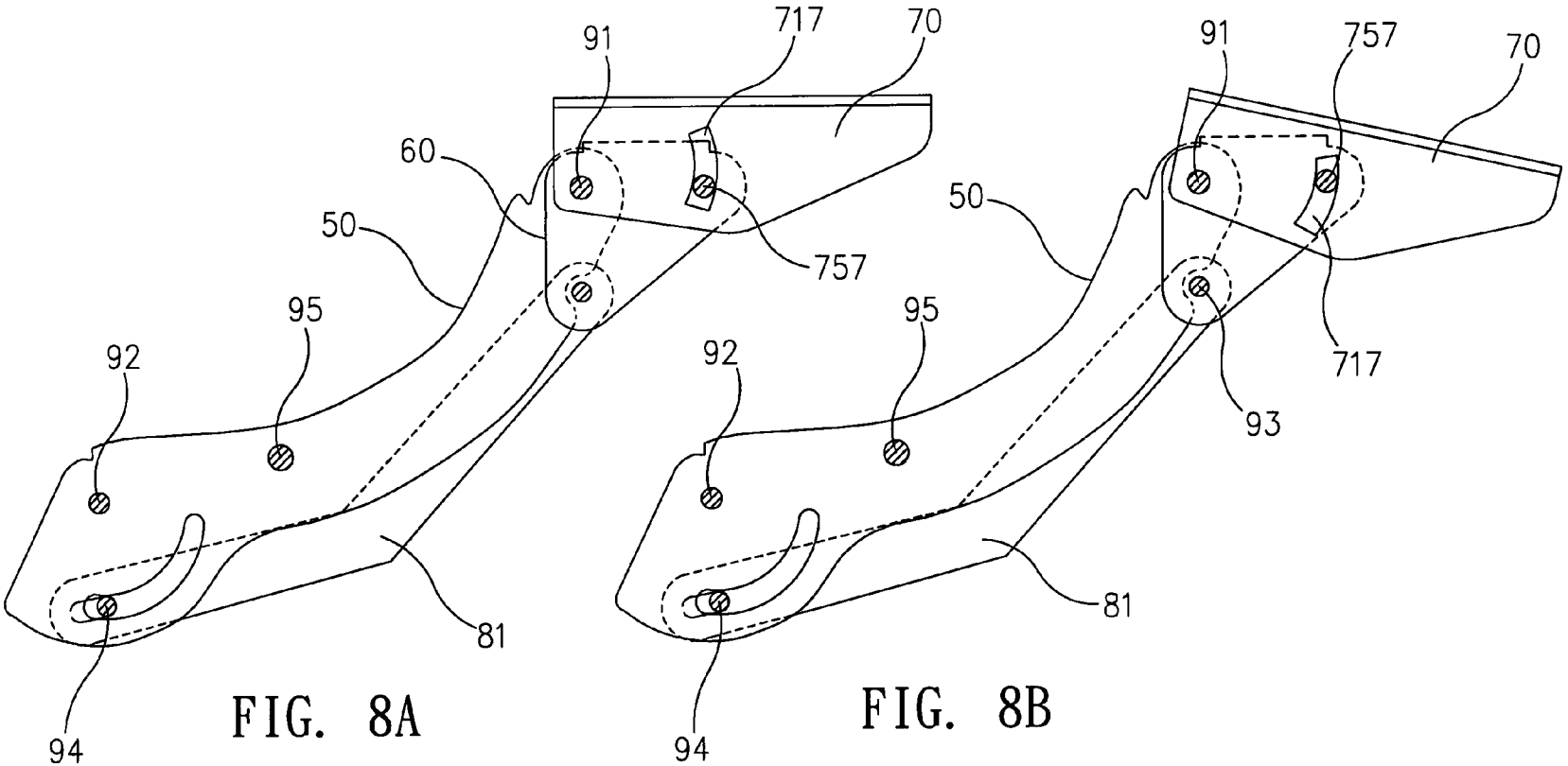
FIG. 8A is a side view in an enlarged scale of a part of the present invention, showing the supporting frame adjusted to a first angle.
FIG. 8B is similar to FIG. 8A but showing the supporting frame adjusted to a second angle.

Referring to FIGS. 8A and 8B, when the supporting frame 70 and the coupling frame 60 are in the loosened status (unlocking position), the supporting frame 70 is turnable about the first pivot pin 91 relative to the coupling frame 60. When turning the supporting frame 70 about the first pivot pin 91 relative to the coupling frame 60 at this time, the axle 757 is constrained by the second axle holes 617 of the coupling frame 60 and forced to move along the smoothly arched sliding slots 717 of the supporting frame 70. After the supporting frame 70 has been adjusted to the desired angle, turn the locking lever 751 to the locking position to lock the supporting frame 70 to the coupling frame 60.

Although the present invention has been explained in relation to its preferred embodiment, it is to be understood that many other possible modifications and variations can be made without departing from the spirit and scope of the invention as hereinafter claimed.

What is claimed is:

1. A self-locking keyboard bracket, comprising:

a base frame, comprising at least one side wing, each side wing of said base frame comprising a first axle hole and a second axle hole;

a connecting frame, comprising at lest one side wing, each side wing of said connecting frame comprising a first axle hole disposed near one end thereof and a second axle hole disposed near an opposite end thereof;

a coupling frame, comprising at least one side wing, each side wing of said coupling frame comprising a first axle hole and a second axle hole; a supporting frame, comprising at least one side wing, each side wing of said supporting frame comprising an axle hole and a smoothly arched sliding slot;

a braking mechanism, comprising at least one link, at least one beveled guide block, and a first sleeve, each said link comprising a first axle hole transversely extended through a first end thereof, a beveled block fixedly provided at a second end thereof, and a second axle hole transversely extended through said beveled block and said second end, each said beveled guide block comprising a coupling groove disposed at one side and coupled to the beveled block of the second end of one said link and an axle hole transversely extended through said coupling groove;

a first pivot pin mounted in the axle hole in each downward side wing of said supporting frame, the first axle hole in each downward side wing of said coupling frame and the first axle hole in each downward side wing of said connecting frame to pivotally secure said supporting frame, said coupling frame and said connecting frame together;

a second pivot pin mounted in the first axle hole in each downward side wing of said base frame and the second axle hole in each downward side wing of said connecting frame for enabling said connecting frame to be turned relative to said base frame;

a third pivot mounted in the third axle hole in each downward side wing of said coupling frame and the first axle hole of each said link of said braking mechanism to pivotally couple said braking mechanism to said coupling frame;

a fourth pivot pin mounted in the second axle hole in each downward side wing of said base frame, the axle hole of each said beveled guide block, the second axle hole of each said link and said first sleeve to pivotally secure said braking mechanism to said base frame, allowing relative swivel motion between said braking mechanism and said base frame; and an angle adjustment control unit, comprising an axle inserted through the smoothly arched sliding slot in each downward side wing of aid supporting frame and the second axle hole in each downward side wing of said coupling frame, said axle having a first end and a second end, a fastening device fastened to the second end of said axle and stopped against one side of one side wing of said supporting frame, and a locking lever pivoted to the first end of said axle and turnable relative to said axle between a first position to lock said supporting frame to said coupling frame and a second position to unlock said supporting frame from said coupling frame, said locking lever comprising a cam disposed at one end and pivoted to the first end of said axle and stopped at one side of one side wing of said supporting frame opposite to said fastening device.

2. The self-locking keyboard bracket as claimed in claim 1, wherein the diameter of the second axle hole of each said link is greater than the outer diameter of said fourth pivot pin.

3. The self-locking keyboard bracket as claimed in claim 1, wherein each side wing of said connecting frame further comprises a smoothly arched sliding slot coupled to said fourth pivot pin between the at least one side wing of said base frame and said at least one beveled guide block.

4. The self-locking keyboard bracket as claimed in claim 1, further comprising a spring member sleeved onto said second pivot pin and stopped between said base frame and said connecting frame.

5. The self-locking keyboard bracket as claimed in claim 1, wherein said angle adjustment control unit further comprises a barrel sleeved onto said axle and stopped between one side wing of said supporting frame and said cam of said locking lever, and a hollow stop block mounted on said axle and stopped between said barrel and said cam of said locking lever.

6. The self-locking keyboard bracket as claimed in claim 1 further comprising a second sleeve sleeved onto said third pivot pin and adapted to keep a gap space between said at least one link and the at least one side wing of said coupling frame.

7. The self-locking keyboard bracket as claimed in claim 2, wherein said braking mechanism further comprises at least one packing member, each said packing member comprising a smoothly arched sliding slot disposed at one end thereof and coupled to said fourth pivot pint, and an axle hole pivotally coupled to the at least one side wing of said connecting frame; the at least one side wing of said connecting frame each further comprises a third axle hole gap spaced between the first axle hole and second axle hole of the respective side wing and pivotally connected to the axle hole of each said packing member with a fifth pivot pin.

8. The self-locking keyboard bracket as claimed in claim 1, wherein said braking mechanism further comprises at least one washer respectively mounted on said fourth pivot pin and stopped between one end of said first sleeve and one said link.

9. The self-locking keyboard bracket as claimed in claim 1, further comprising a track, said track comprising two parallel sliding grooves, and a slide fastened to said base frame and coupled to said track, said slide comprising two side flanges longitudinally slidably inserted into the sliding grooves of said track for allowing relative movement between said slide and said track.

10. The self-locking keyboard bracket as claimed in claim 9, wherein said slide further comprises a vertically extended center axle hole pivotally connected to said base frame with a pivot pin for allowing relative rotation in horizontal direction between said slide and said base frame.

* * * * *